United States Patent [19]

Major

[11] Patent Number: 4,977,976

[45] Date of Patent: Dec. 18, 1990

[54] CONNECTOR FOR HEARING AIR EARMOLD

[75] Inventor: Miklos Major, Ambridge, Pa.

[73] Assignee: Microsonic, Inc., Ambridge, Pa.

[21] Appl. No.: 250,016

[22] Filed: Sep. 27, 1988

[51] Int. Cl.[5] ..... H04R 25/02

[52] U.S. Cl. ..... 181/130; 181/135; 381/68.6

[58] Field of Search ..... 181/129–131, 181/135; 381/68.6, 69, 188, 68.5, 68.7; 285/155–157, 179, 921

[56] References Cited

U.S. PATENT DOCUMENTS

| | | | |
|---|---|---|---|
| 3,813,499 | 5/1974 | Vignini | 381/68.7 |
| 4,311,206 | 1/1982 | Johnson | 181/135 |
| 4,381,830 | 5/1983 | Jelonek et al. | 181/129 |
| 4,677,675 | 6/1987 | Killion et al. | 381/68.7 X |
| 4,722,556 | 2/1988 | Todd | 285/179 X |

FOREIGN PATENT DOCUMENTS

| | | |
|---|---|---|
| 473524 | 7/1969 | Switzerland . |

*Primary Examiner*—Benjamin R. Fuller
*Attorney, Agent, or Firm*—Kirkpatrick & Lockhart

[57] ABSTRACT

The present invention proves an elbow shaped connector for connecting flexible sound conduction tubing from a hearing aid to a conventional earmold. The sound bore of the connector has an increasing diameter to improve high frequency response. This increase in diameter may be gradual, over the length of the connector, or it may occur abruptly at some point within the connector.

5 Claims, 1 Drawing Sheet

CONNECTOR FOR HEARING AIR EARMOLD

BACKGROUND OF THE INVENTION

1. Field of the Invention

The present invention relates generally to hearing aids. More specifically, it relates to an elbow shaped device which connects earmold tubing from a hearing aid to an earmold and which enhances high frequency response within the elbow.

2. Description of the Prior Art

A conventional hearing aid apparatus is comprised of the actual hearing aid having a sound exit port, to which flexible plastic sound conduction tubing is attached. Such tubing is permanently attached to a sound input port in an earmold. The earmold is disposed in the ear of the wearer. Sound travels from the hearing aid, through the tubing, and through a bore in the earmold directly into the user's ear canal. In such a design, tubing replacement is difficult and costly.

An elbow shaped means for connecting the sound conduction tubing to the earmold is known in the art. For example, Jelonek et al. (U.S. Pat. No. 4,381,830) discloses an elbow connector designed to provide a sound conducting bore of constant internal diameter between the sound conduction tubing attached to a hearing aid and the sound conduction bore of the earmold. As such, a continuous flow sound conduction path is established from the hearing aid through the earmold into the ear canal. The end of the sound conduction tubing may be spaced from a shoulder within the sound conduction bore of the connector thereby forming a resonance chamber to increase the strength of high frequency signals.

An increase in the diameter of the sound conduction tubing at the point nearest the earmold is also known in the art. This increase has been accomplished in two ways. Two sections of sound conduction tubing with different diameters are cemented together via a difficult and time consuming process. Alternatively, a single sound conduction tube with an internal step-up in diameter may be molded. However, Applicant has learned that molding tubing with an internal increase in diameter is prohibitively expensive. In addition, the molding process weakens the tubing, making it less durable. Therefore, replacement of the sound conduction tubing is required frequently and at significant expense. In either of the above described methods for increasing the diameter of the tubing, the tubing end is cemented into the earmold, making replacement of the tubing sections inconvenient.

Johnson (U.S. Pat. No. 4,311,206) discloses an abrupt change in diameter of the sound conduction passage from constant diameter tubing to a bore of increased volume within the earmold. The interior chamber of the earmold is drilled to various geometric shapes and volumes to define a particular acoustic resonating system. To accomplish this method of increasing high frequency response, the earmold is split into two sections, a cavity of desired volume is drilled, and the earmold is cemented back together. An earmold thus produced is costly.

Accordingly, the need exists for a connector which facilitates easy replacement of sound conduction tubing while providing a means for improving high frequency response.

SUMMARY OF THE INVENTION

The present invention relates to a means for connecting sound conduction tubing from a hearing aid device to a sound conduction opening in an earmold.

This invention includes an elbow shaped connector made from a plastic material. One end of the connector is provided with a male tip which is notched so that it is capable of receiving and retaining flexible plastic sound conduction tubing of a variety of sizes. The other end of the connector has a stepped region which fits into a properly dimensioned plug in the earmold. The sound passage through the elbow connector has an increase in bore size which provides enhanced high frequency response. This increase in bore size may be continuous or stepped within the connector.

An object of the present invention is to provide a connector for connecting sound conduction tubing from a hearing aid to a sound conduction opening of an earmold.

Another object of the invention is to provide an elbow shaped connector for connecting sound conduction tubing from a hearing aid to a sound conduction opening of an earmold so that the diameter of the sound conduction path increases along the length of the connector.

An additional object of the invention is to provide a means for securing the connector of increasing interior diameter into a sound conduction opening of the earmold.

Another object of the invention is to provide a means of easily replacing old sound conduction tubing without removing the earmold from the ear of the wearer.

These and other objects and advantages of this invention will become apparent as the following description and accompanying drawings are considered.

BRIEF DESCRIPTION OF THE DRAWINGS

In order that the present invention may be clearly understood and readily practiced, preferred embodiments will now be described, by way of example only, with reference to the accompanying figures wherein.

DETAILED DESCRIPTION OF THE PREFERRED EMBODIMENTS

Figure 1:
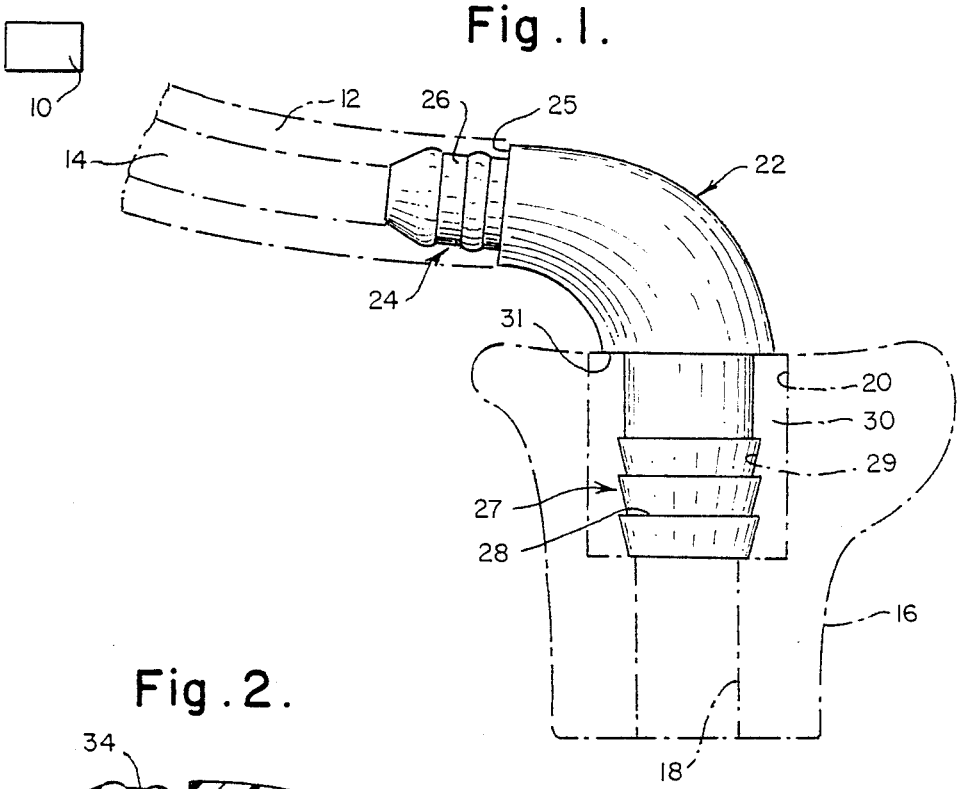
FIG. 1 is a side view of an earmold, a connector for sound conduction tubing and sound conduction tubing.
Figure 2:
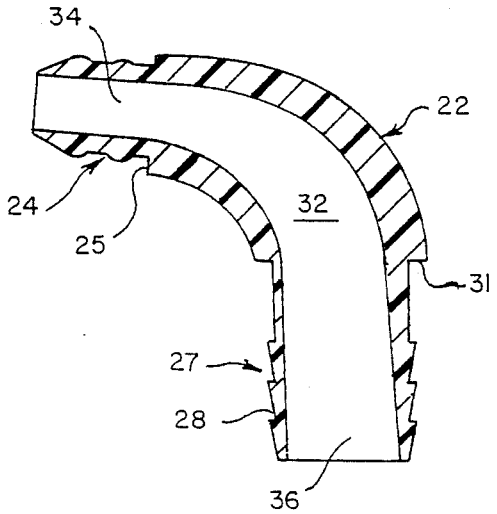
FIG. 2 is a cross-sectional view of the connector for sound conduction tubing.

A conventional hearing aid, generally indicated as 10 in FIG. 1, has a sound exit port to which flexible plastic sound conduction tubing 12 is attached. Such tubing has an internal passage 14 of constant diameter through which sound waves travel.

An earmold 16 is specially molded from a plastic material to conform to the ear of the wearer. The earmold includes a sound conduction bore 18 extending from an opening 20 in the earmold 16 throughout its length, thus enabling sound waves to pass through the earmold 16 into the ear canal of the wearer.

An elbow shaped connector 22 may be molded from a suitable material. The connector has a tubing receiving end consisting of a male member 24 which includes notches 26 so that it may accommodate and retain sound conduction tubing 12 of various sizes adjacent a shoulder 25 adjacent male member 24. This arrangement permits easy replacement of tubing 12 by simple disengagement of such from the male member 24. The other end 27 of the connector 22 also includes a stepped portion 28. The stepped portion 28 fits into a bore 29 within a plug 30 which is fitted within opening 20 in the earmold 16. The bore 29 is dimensioned to conform to the stepped region 28, creating an acoustic seal when the plug 30 receives the end 27. When the connector 22 is installed in the earmold 16, a shoulder 31 adjacent end 27 abuts the plug 30.

A tubular sound passage 32 extends through the connector 22 from tubing receiving end 24 to the earmold end 27. The bore size of the sound passage 32 is increased to provide an increase in diameter of the passage from a first diameter 34 to a second diameter 36. Diameter 34 is identical to that of the internal passage 14 of sound conduction tubing 12. The second diameter 36 is identical to that of the sound conduction bore 18 of the earmold 16. This increase in diameter provides the effect of enhancing high frequency response within the connector 22.

The diameter of sound bore 32 is gradually increased from first diameter 34 to second diameter 36. The second diameter 36 is reached in connector 22 at about the location of shoulder 31 and continues through the portion of the connector 22 which engages the earmold 16. This second diameter continues through the sound bore 18 of the earmold to reach the ear canal of the wearer.

In a presently contemplated embodiment of the connector 22, the first diameter 34 may be approximately 0.076 inches and the second diameter 36 may be 0.125 inches. Also, with reference to FIG. 1, horizontal length of connector 22 from shoulder 25 to the right side of connector 22 may be 0.35 inches and the vertical length from shoulder 31 to the top of connector 22 may be 0.25 inches. The connector may be formed from a "soft" material such as vinyl, silicon or PVC or from a semi-soft material or from a relatively "hard" material such as an acrylic. In any event, the connector may be formed from any material from which earmolds are formed.

Figure 3:
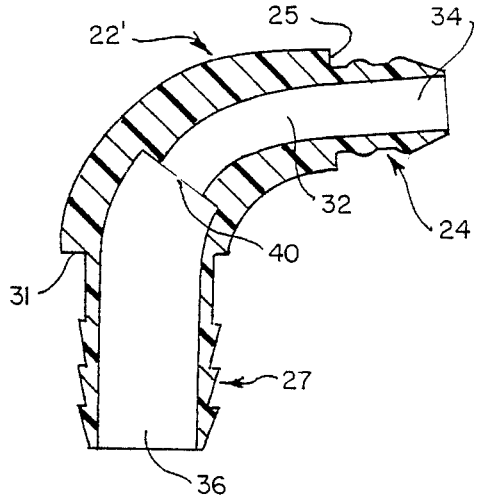
FIG. 3 is a cross-sectional view of an alternative embodiment of the connector according to the present invention where the increase in diameter of the sound conduction path is abrupt, rather than gradual.

FIG. 3 illustrates an alternative embodiment of the connector 22' wherein the increase from first diameter 34 to second diameter 36 is abrupt, rather than gradual. The incoming first diameter 34 continues in the connector 22' until the second and larger diameter 36 begins at step 40. The exact location of step 40 is not critical so long as it occurs at a suitable distance before the location of shoulder 31. If the change occurs too close to the outer face of the earmold 16, acoustical results will be unsatisfactory.

While the present invention has been described in conjunction with an exemplary embodiment thereof, it will be understood that many modifications and variations will be readily apparent to those of ordinary skill in the art. This disclosure and the following claims are intended to cover all such modifications and variations.

What is claimed is:

1. A connector for connecting sound conduction tubing from a hearing aid to a sound conduction bore of an earmold comprising:

an elbow shaped member having a tubing receiving section and an earmold connection section;

said elbow shaped member having a single internal unobstructed sound transmitting bore between said tubing receiving section and said earmold connection section, said sound transmitting bore having a diameter which increases from a first diameter portion at said tubing receiving section to a second diameter portion at said earmold connection section.

2. A connector according to claim 1 wherein the diameter of said sound transmitting bore gradually increases from said first diameter portion to said second diameter portion.

3. A connector according to claim 1 wherein the diameter of said sound transmitting bore abruptly increases from said first diameter portion to said second diameter portion.

4. A connector according to claim 1 wherein said first diameter portion is equal to an internal diameter of said sound conduction tubing.

5. A connector according to claim 1 wherein said second diameter portion is equal to a diameter of said sound conduction bore.

* * * * *

UNITED STATES PATENT AND TRADEMARK OFFICE

CERTIFICATE OF CORRECTION

PATENT NO. : 4,977,976

DATED : 12/18/90

INVENTOR(S) : Miklos Major

It is certified that error appears in the above-identified patent and that said Letters Patent is hereby corrected as shown below:

On the title page, item [54], and in column 1, line 1, in the title delete "AIR" and substitute therefor --AID--.

Signed and Sealed this

Twentieth Day of October, 1992

*Attest:*

DOUGLAS B. COMER

*Attesting Officer*

*Acting Commissioner of Patents and Trademarks*